US006099962A

United States Patent [19]

Sato et al.

[11] Patent Number: 6,099,962

[45] Date of Patent: Aug. 8, 2000

[54] FABRIC HAVING SHAPE STABILITY AND/OR WATER RESISTANCE, AND CORE-SHEATH COMPOSITE YARN USED IN THE SAME

[75] Inventors: Ryosuke Sato, Hyogo; Shigeki Honda, Fukui; Shoichiro Noguchi, Kyoto; Shogo Mutagami, Osaka, all of Japan

[73] Assignee: Kanebo Ltd., Tokyo, Japan

[21] Appl. No.: 09/117,196

[22] PCT Filed: Jan. 30, 1997

[86] PCT No.: PCT/JP97/00253

§ 371 Date: Nov. 2, 1998

§ 102(e) Date: Nov. 2, 1998

[87] PCT Pub. No.: WO97/28299

PCT Pub. Date: Jul. 8, 1997

[30] Foreign Application Priority Data

| | | | |
|---|---|---|---|
| Feb. 2, 1996 | [JP] | Japan | 8-040715 |
| Mar. 18, 1996 | [JP] | Japan | 8-090116 |
| Mar. 18, 1996 | [JP] | Japan | 8-090495 |
| Mar. 21, 1996 | [JP] | Japan | 8-093151 |
| Jun. 11, 1996 | [JP] | Japan | 8-173053 |
| Jul. 15, 1996 | [JP] | Japan | 8-205186 |
| Jul. 18, 1996 | [JP] | Japan | 8-208929 |
| Nov. 7, 1996 | [JP] | Japan | 8-313114 |
| Dec. 24, 1996 | [JP] | Japan | 8-356178 |

[51] Int. Cl.[7] ..... D02G 3/00

[52] U.S. Cl. ..... 428/377; 428/196; 428/198; 428/378; 38/144; 264/103

[58] Field of Search ..... 428/377, 378, 428/394, 395, 196, 198; 442/200, 311, 364; 38/144; 264/103

[56] References Cited

FOREIGN PATENT DOCUMENTS

| | | |
|---|---|---|
| 2-91238 | 3/1990 | Japan . |
| 3-241012 | 10/1991 | Japan . |
| 4-11006 | 1/1992 | Japan . |
| 4-82932 | 3/1992 | Japan . |
| 7-252742 | 10/1995 | Japan . |

*Primary Examiner*—Christopher Raimund
*Attorney, Agent, or Firm*—Loeb & Loeb, LLP

[57] ABSTRACT

A core-sheath composite yarn characterized in that a softening point of a core component as measured by thermomechanical analysis of JIS K 7196 is at least 20° C. lower than a softening point of a sheath component, and the core component is formed of a substantially amorphous polymer that does not provide a melting point peak as measured by differential thermal analysis of conducting heating in a nitrogen atmosphere at a rate of temperature rise of 10° C./min, and a fabric obtained by using such a composite yarn. This fabric has an excellent shape stability and an excellent water resistance by heat-setting.

14 Claims, 2 Drawing Sheets

FABRIC HAVING SHAPE STABILITY AND/OR WATER RESISTANCE, AND CORE-SHEATH COMPOSITE YARN USED IN THE SAME

CROSS REFERENCE TO RELATED APPLICATION

This application claims priority based on PCT Application No. PCT/JP97/00253, filed Jan. 30, 1997 identifying the United States as an elected country.

TECHNICAL FIELD

The present invention relates to a fabric obtained by thermosetting and having a shape stability and/or a water resistance, and a core-sheath composite yarn used in the same.

BACKGROUND ART

A fabric obtained by using a composite yarn having a core-sheath cross-sectional shape (hereinafter referred to as a normal core-sheath composite yarn) in which a low-melting polymer is used as a sheath component and an intermingled point of a warp and a weft is fused and fixed through heat treatment has been used for various purposes.

However, in this type of the fabric, a texture is bad (hard), and a low-boiling polymer component appears on the surface of the fabric, decreasing a color fastness or deteriorating a dyeability. Thus, the use of this fabric in clothing is problematic.

On the contrary, as a fabric formed of a core-sheath composite yarn in which a low-melting polymer is used as a core component (hereinafter referred to as an inverted core-sheath composite yarn), only some examples are disclosed. For example, in Japanese Patent Laid-Open No. 220,770/1984, in order to obtain a fabric having a clear wavy uneven pattern and a sharp color difference on the surface, an inverted core-sheath composite yarn is employed in which an ethylene-vinyl acetate copolymer is used as a core component and a polyamide component as a sheath component, respectively. Japanese Patent Laid-Open No. 11,006/1992 discloses the use of a false-twisted yarn formed of an inverted core-sheath composite fiber in which a low-melting polymer is arranged as a core component for developing a sports wear having an improved abrasion-resistant meltability.

The former fabric is obtained by bending and heat-setting. Unless the heat treatment conditions are strictly controlled, the texture of the fabric becomes poor, or the bent portion is weakly fixed. Products except a product having a wavy uneven surface were not applied to any special use. The latter fabric is used to develop clothing which is not broken owing to abrasion by sliding or the like. Although employing the inverted core-sheath composite yarn in which the low-boiling polymer is used as the core component, this composite yarn is not particularly effective at all for moldability and the like of a fabric or clothing.

On the other hand, it has been so far deemed indispensable to coat a melamine resin, an acrylic resin or the like on a surface of a fabric in order to obtain a waterproof fabric which provides a shape stability in pleating, hard finishing or the like and which is suited for an umbrella fabric.

However, the coating with these resins gives a hard texture or some resins cause a trouble such as an offensive odor in heat-molding or the like. In addition to this, in the coating with an acrylic resin or the like, migration of a dye is liable to occur on the coating surface. For example, in an umbrella which is left on a rear window of a vehicle, a dye migrates soon so that the color of the umbrella becomes uneven or a print pattern becomes unclear. Such fatal defects as a product occur.

With respect to a method for obtaining a water-resistant fabric, heat treatment under increased pressure such as calendering or the like is generally known. However, even though a fabric formed of an ordinary polyester yarn is calendered, interstices of intermingled points of a yarn cannot completely be filled, and it is difficult to obtain a great water resistance.

It is an object of the present invention to provide a fabric obtained by using a core-sheath composite yarn and having a shape stability of a good texture and/or a high water resistance, and a novel core-sheath composite yarn which is used in this fabric.

Further, the present inventors have considered that quite a useful final product is obtained by applying the shape stability of the core-sheath composite yarn to a specific use.

For example, a fabric having an excellent surface smoothness can be obtained by heat-treating a woven or knitted fabric obtained by using a covering yarn formed of the core-sheath composite yarn and a urethane elastic yarn under increased pressure. In such a fabric, a fluid resistance to air or water of a wear surface decreases a speed in a swimming race, a skiing race, a snow board race, a bicycle race, a speed skating or the like. Accordingly, a method has been so far known in which a urethane resin is coated on the surface of the fabric or a film is laminated thereon to improve a smoothness.

However, the conventional fabric is poor in moisture permeability and air permeability because of a resin layer or a film layer having few interstices, and involves problems that it has a high density and a great thickness. For this reason, a fabric which has a lighter weight, a better moisture permeability and a better air permeability is deemed preferable as a sports material. Thus, it has been required to obtain a fabric which is excellent in a smoothness and a water resistance without conducting resin coating or film lamination.

Besides, an embossed pattern having a durability can be formed by embossing a fabric made of the core-sheath composite yarn or the like. With respect to the embossing, in general, a hard engraved heat roll and a soft roll combined therewith are rotated under appropriate increased pressure, and a fabric is introduced between these rolls, making it possible to easily apply the uneven pattern to the fabric. However, the form tends to become unclear, and a conventional fabric formed of usual polyester yarns lacks a durability, and the raised and recessed pattern easily decreases or disappears through washing or the like.

In addition, a fiber has been so far known which exhibits a shape stability or the like by fusing a low-melting portion on the surface through heat treatment. However, such a fiber is problematic in that a texture is hardened as mentioned above, and its use has been limited.

Another object of the present invention is to provide quite a useful final product which gives specific function and effect based on a shape stability of a specific core-sheath composite yarn by applying this core-sheath composite yarn to a specific usage and which could not be formed by using the conventional core-sheath composite yarn.

DISCLOSURE OF THE INVENTION

The present invention is concerned with a core-sheath composite yarn formed of different types of polymers in which a softening point of a core component as measured by thermomechanical analysis of JIS K 7196 is at least 20° C. lower than a softening point of a sheath component, and the core component is formed of a substantially amorphous polymer that does not provide a melting point peak as measured by differential thermal analysis of conducting heating in a nitrogen atmosphere at a rate of temperature rise of 10° C./min (hereinafter referred to as an "amorphous inverted core-sheath composite yarn").

Further, the present invention is concerned with a fabric, an artificial flower and a wig obtained by using such an amorphous inverted core-sheath composite yarn and having a shape stability.

Since the substantially amorphous polymer having a low crystallinity is used as a core component in such an amorphous inverted core-sheath composite yarn, softening and solidification can reversibly be repeated even in repeating heating and cooling, and setting properties such as a flatness of a yarn through heating under increased pressure and the like are very good.

In addition, the present invention is concerned with an embossed fabric having an excellent shape stability which is obtained by pressing an engraved heat roll on a fabric formed of multifilaments of thermoplastic synthetic fibers in which multifilaments composed of the amorphous inverted core-sheath composite yarns are used in the whole or a part of warps and/or wefts, and a sum of textile cover factors in warp and weft directions is within the range of from 800 and 2,500.

In this fabric, a pattern is not formed on the basis of the uneven form of the fabric through heat-pressing, but a raised pattern drawn on a heat roll is formed on a fabric by pressing a sheath component formed of an amorphous polymer having a low softening point through a hard heat roll of an embossing machine and changing and increasing the filament diameter thereof. Accordingly, a durable embossed pattern is provided.

Still further, the present invention is concerned with a heat-resistant fabric at least a part of which is formed of an inverted core-sheath composite yarn in which a melting point of a core component is lower than that of a sheath component, characterized in that the fabric is shaped in a flat state by conducting heat-setting at a temperature of more than a softening point of the core component and less than a melting point of the sheath component under increased pressure.

Such a fabric is a water-resistant fabric having no interstices of intersecting points of yarns constituting the same.

Figure 1:
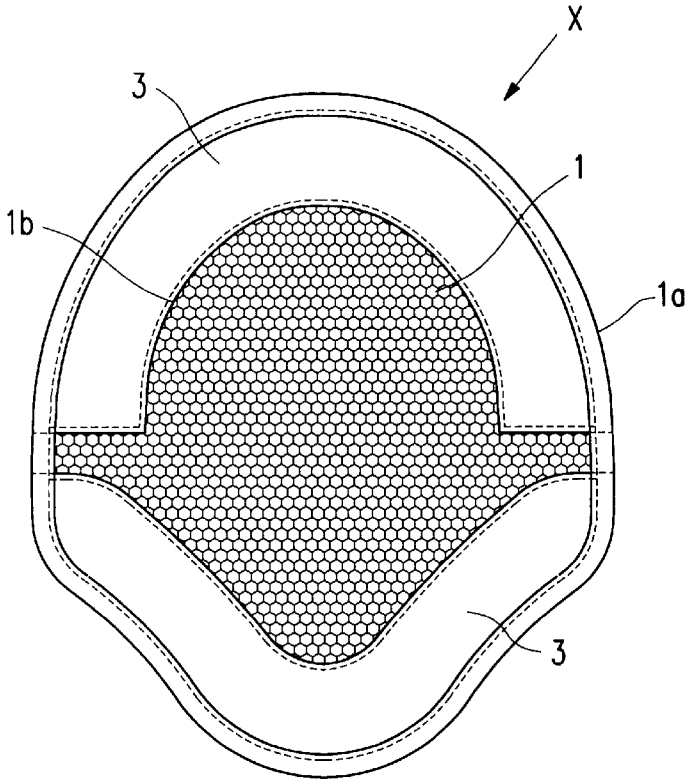
FIG. 1 is a plan view of a wig of the present invention as observed from the inside.
Figure 2:
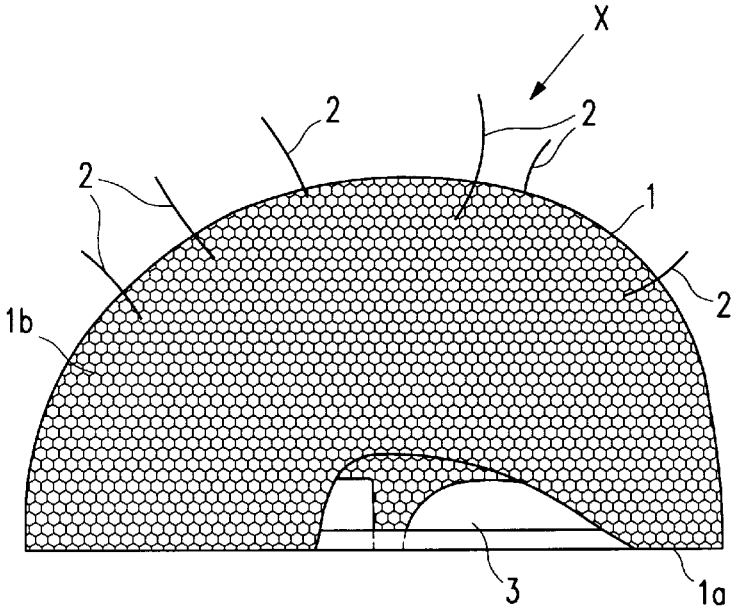
FIG. 2 is a side view of its outside.

BEST MODE FOR CARRYING OUT THE INVENTION (1) Description of an Amorphous Inverted Core-Sheath Composite Yarn The amorphous inverted core-sheath composite yarn of the present invention is a core-sheath composite yarn in which a softening point of a core component as measured by thermomechanical analysis of JIS K 7196 is at least 20° C. lower than that of a sheath component. The composite yarn in which the core component is formed of a substantially amorphous polymer that does not provide a melting point peak as measured by differential thermal analysis of conducting heating in a nitrogen atmosphere at a rate of temperature rise of 10° C./min is especially preferably a core-sheath composite yarn in which a sheath component is formed of a polyester, and a core component is formed of a copolyester-type polymer having a glass transition point of from 60 to 80° C. and a softening point of 200° C. or less.

In a typical example of such a copolyester, terephthalic acid and ethylene glycol are used as main components. With respect to a copolymerizable component, one or more types of known dicarboxylic acid components selected from oxalic acid, malonic acid, succinic acid, adipic acid, azelaic acid, sebacic acid, phthalic acid, isophthalic acid, naphthalenedicarboxylic acid and diphenyl ether dicarboxylic acid are used as an acid component, and one or more types of known diol components selected from 1,4-butanediol, 1,6-hexanediol, neopentyl glycol, propylene glycol, trimethylene glycol, tetramethylene glycol, hexamethylene glycol, diethylene glycol, polyalkylene glycols and 1,4-cyclohexanedimethanol are used as a diol component. It is advisable to use the copolymerizable component at a ratio of 50 mol % or less. Diethylene glycol, polyethylene glycol or the like may be added as another copolymerizable component.

In the copolyester, the above-mentioned copolymerizable component may be used by being appropriately selected to give a desired softening point unless impairing a spinnability and a processability. A copolyester obtained by using terephthalic acid and ethylene glycol as main components and isophthalic acid as a copolymerizable component is preferable because it can be obtained industrially at low costs and stably and has good polymer properties. In such an isophthalic acid copolyester, the amount of the isophthalic acid component is preferably between 20 and 40 mol %, and the core/sheath ratio of the core-sheath composite yarn is between 5/1 and 1/5, especially preferably between 3/1 and 1/2 in terms of a volume ratio. The sectional shape of the composite yarn may be any of circular, elliptical, polygonal and star-like shapes. Further, the core and the sheath may be arranged concentrically or eccentrically. In general, it is advisable to use a composite yarn having a circular sectional shape in which a core and a sheath are arranged concentrically.

Since the substantially amorphous polymer having a low crystallinity is used as a core component in such a composite yarn, softening and solidification can reversibly be repeated even in repeating heating and cooling, and setting properties such as a flatness of a yarn through heating under increased pressure and the like are very good.

Accordingly, the fabric formed upon using such a composite yarn has the following advantages.

(1) It is possible that the shape which is once heat-set is released again by heating and a new shape is heat-set. For example, it is possible that a pleated curtain is produced by applying pleats having a width of 5 cm through heat-setting, these pleats are then released, and different pleats (for example, pleats having a width of 3 cm) are applied thereto to provide another pleated curtain with good qualities.

(2) A water-resistant product which is used in an umbrella fabric or waterproof clothing can be produced at good efficiency by mere heat-setting under increased pressure through ordinary calendering without coating a resin. The resin coating can be employed in combination depending on the use.

(3) The thus-obtained water resistance or the shape retention leads to a high durability in washing.

(4) Since no core component of the composite yarn appears on the surface of the fabric, the texture does not become hard, and the problems such as a decrease in a color fastness and a decrease in a leveling property can hardly occur.

EXAMPLE 1

The following three types of raw yarns were prepared.

Raw yarn (a1)—A core-sheath composite fiber wherein copolyethylene terephthalate containing isophthalic acid (IPA) occupying 12 mol % of an acid component and having a melting point of 227° C. (DSC) and a softening point of 197° C. was used as a core and polyethylene terephthalate (melting point 255° C., softening point 240° C.) containing 100-% terephthalic acid as an acid component was used as a sheath, was spun at a core/sheath ratio (volume ratio) of 1:1 to form a yarn of 50 d/12 f.

Raw yarn (b1)—Yarn of 50 d/12 f in which the core component and the sheath component of the raw yarn (a1) were inverted.

Raw yarn (c1)—Regular polyester yarn of 50 d/12 f in which 100-% terephthalic acid was used as an acid component.

Each of these three types of the raw yarns was used as a weft of a fabric in which a regular polyester raw yarn of 50 d/24 f containing 100-% terephthalic acid as an acid component was used as a warp. Plain weave fabrics (A1, B1, C1) were produced such that densities of a weft and a warp as finished were 110 yarns/inch and 94 yarns/inch, respectively. The resulting fabrics were subjected to the same finishing and dyeing (jet dyeing machine) under the same conditions as in obtaining an ordinary polyester plain weave fabric.

At this stage, the fabric (A1) of the present invention and the fabric (C1) being the usual polyester fabric could be the uniform dyed fabrics. However, in the fabric (B1) in which the core-sheath composite fiber having the low-melting component as the sheath was used as a weft, dyed spots were given, and wrinkles remained, providing a bad appearance.

Next, the thus-obtained dyed fabric was subjected to usual water repellent finishing using a fluorine-type water repellent, and to heat-treatment (calendering) at 200° C. and a pressure of 35 kg/cm$^2$. A water resistance was measured immediately after this procedure and after 10 washings.

The results are shown in Table 1.

TABLE 1

| Type of a fabric | Fabric A1 | | Fabric B1 | | Fabric C1 | |
|---|---|---|---|---|---|---|
| Raw yarn used as a weft | (a1) composite yarn of Invention | | (b1) composite yarn having a low-melting sheath component | | (c1) regular polyester | |
| Texture of a product | good | | bad (hard) | | common | |
| Appearance of a product | good | | bad (wrinkles remain in dyeing) | | good | |
| Number of washings | 0 | 10 | 0 | 10 | 0 | 10 |
| Hydraulic pressure resistance (cm) | 40.0 | 35.5 | 30.0 | 25.0 | 22.5 | 20.0 |

The fabric (A1) in accordance with the present invention had a soft texture and a high hydraulic pressure resistance, and could be used as an umbrella fabric. In contrast, the fabric (B1) showed a higher hydraulic pressure resistance than the usual polyester fabric (C1), but its value was unsatisfactory in the use for an umbrella fabric or the like. Further, wrinkles formed by dyeing remained, and the texture was hard. Thus, it was not a practical one.

EXAMPLE 2

The following three types of raw yarns were prepared.

Raw yarn (a2)—A core-sheath composite fiber wherein copolyethylene terephthalate containing isophthalic acid (IPA) occupying 12 mol % of an acid component and having a softening point of approximately 150° C. with substantially no melting point peak as measured by DSC was used as a core and polyethylene terephthalate (melting point 255° C., softening point 240° C.) containing 100-% terephthalic acid as an acid component was used as a sheath, was spun at a core/sheath ratio (volume ratio) of 1:1 to form a yarn of 50 d/12 f.

Raw yarn (b2)—Yarn of 50 d/12 f in which the core component and the sheath component of the raw yarn (a2) were inverted.

Raw yarn (c2)—Regular polyester yarn of 50 d/12 f in which 100-% terephthalic acid was used as an acid component.

Each of these three types of the raw yarns was used as a weft of a fabric in which a regular polyester raw yarn of 50 d/48 f containing 100-% terephthalic acid as an acid component was used as a warp. Plain weave fabrics (A2, B2, C2) were produced such that densities of a warp and a weft as finished were 175 yarns/inch and 105 yarns/inch respectively. The resulting fabrics were subjected to the same finishing and dyeing (jet dyeing machine) under the same conditions as in obtaining an ordinary polyester plain weave fabric. Subsequently, the thus-obtained dyed fabrics were subjected to the usual water repellent finishing using a fluorine-type water repellent.

Table 2 shows the results of measuring the shape stability of the fabrics after the water repellent finishing and the results of measuring the hydraulic pressure resistance and the shape stability of the fabrics heat-treated at 160° C.

TABLE 2

| | | Hydraulic pressure resistance test | | Shape stability test | |
|---|---|---|---|---|---|
| Fabric | Weft | Calendering temperature | Hydraulic pressure resistance (cm) | Heat treatment temperature | Stability |
| A2 | (a2) Composite yarn of Invention | 160° C. | 100 or more | 140° C.<br>160° C. | Δ<br>○ |
| B2 | (b2) Composite yarn with a low-melting sheath component | 160° C. | 71 | 140° C.<br>160° C. | Δ<br>○ |
| C2 | (c2) Regular polyester | 160° C. | 55 | 140° C.<br>160° C. | x<br>x |

(2) Description of a Urethane Covering Yarn and a Fabric Having a Surface Smoothness An amorphous inverted core-sheath composite yarn can be used in a sports wear or the like in combination with a urethane elastic material. In this case, the urethane elastic yarn may be an ordinary one. A urethane resin used in the elastic yarn may be either a polyester resin or a polyether resin. However, when a heat resistance has to be increased because of a long heat treatment time in the subsequent step, it is advisable to use a polyester-type polyurethane having a better heat resistance. A method of spinning a polyurethane fiber is not particularly limited, and an ordinary method such as melt-spinning, dry-spinning or the like is preferably used.

Specific examples of a method for producing a woven or knitted fabric using these fibers include a method in which a covering yarn is produced wherein a urethane elastic yarn is used as a core yarn and an amorphous inverted core-sheath composite yarn as a sheath yarn, respectively, and a woven or knitted fabric is formed using the same, a method in which a woven or knitted fabric is formed by using an amorphous inverted core-sheath composite yarn and a urethane elastic yarn at the same time, a method in which a woven or knitted fabric is formed using a combined yarn of an amorphous inverted core-sheath composite yarn and a urethane elastic yarn.

When employing a covering yarn obtained by using a urethane elastic yarn as a core yarn and an amorphous inverted core-sheath composite yarn as a sheath yarn, this covering yarn can preferably be produced by a usual method. The winding of the sheath yarn in covering may be either single winding or double winding. Further, such a combined yarn can be used in a woven fabric or a knitted fabric, and a method for producing a woven or knitted fabric is not limited.

As a method for producing a woven or knitted fabric using an amorphous inverted core-sheath composite yarn and a urethane elastic yarn at the same time, a known method can preferably be used, and a desired shape of a woven or knitted fabric can be selected in view of a shape stability and an elasticity required. Specific examples thereof include an ordinary combined stitch of a warp and a weft using an amorphous inverted core-sheath composite yarn and a urethane elastic yarn or an ordinary combined weave thereof, and a knitted texture consisting of a warp texture of an amorphous inverted core-sheath composite yarn and a weft texture of a urethane elastic yarn.

A combined finished yarn of an amorphous inverted core-sheath composite yarn and a urethane elastic yarn can also be produced by a known method. Specific examples thereof include a method in which a finished yarn formed of a composite yarn is combined with a urethane elastic yarn, and a method in which a composite yarn is combined with a urethane elastic yarn, and the combined yarn is false-twisted to form a finished yarn. Further, such a composite combined yarn may be formed into a woven or knitted fabric, and a method for producing the same is not limited.

Besides, the fabric having the surface smoothness in the present invention is one obtained by heat-treating the above-obtained woven or knitted fabric under increased pressure to make smooth the surface thereof. In order to obtain a sports wear having an excellent surface smoothness, it is necessary that the above-mentioned treatment is conducted to form the section of the composite yarn into a flat shape to decrease swelling of the surface in the woven or knitted fabric and to fill interstices. The heat treatment under increased pressure can be conducted by an ordinary method such as calendering or the like.

The heating temperature in this heat treatment under increased pressure is between 150° C. and 200° C., preferably between 160° C. and 180° C. Since the core is a component having a low melting point and a low crystallinity in the amorphous inverted core-sheath composite yarn, the sectional shape of the fiber can be changed at a low temperature, and the heat deterioration of the urethane elastic yarn in the heat treatment step is markedly decreased. Thus, it is desirous. When the heating is conducted at a temperature of higher than 200° C., the heat deterioration of the urethane elastic yarn occurs, and the core component is exposed outside by the melting of the sheath component of the amorphous inverted core-sheath composite yarn to impair the texture of the fabric. Thus, it is undesirous. Further, in the heat treatment at less than 150° C. under increased pressure, the shape of the yarn is not satisfactorily changed, so that no sufficient smoothness is obtained.

EXAMPLE 3

The following properties were measured by the following methods.

Hydraulic pressure resistance: JIS L-1092A method (hydrostatic method)

Softening point: JIS K-7196 method

Production of a combined tricot:

A core-sheath composite fiber wherein copolyethylene terephthalate containing isophthalic acid (IPA) occupying 25 mol % of an acid component and having a softening point of 197° C. with substantially no melting point as measured by DSC was used as a core and polyethylene terephthalate (melting point 255° C., softening point 240° C.) containing 100-% terephthalic acid as an acid component was used as a sheath, was spun at a core/sheath ratio (volume ratio) of 1:1 to form a yarn of 45 d/10 f. This yarn was then false-twisted to give a finished yarn. A combined tricot was formed using such a finished yarn and a urethane elastic yarn of 40 d.

EXAMPLE 4

Production of a covering yarn:

A core-sheath composite fiber wherein copolyethylene terephthalate containing isophthalic acid (IPA) occupying 25 mol % of an acid component and having a softening point of 197° C. with substantially no melting point as measured by DSC was used as a core and polyethylene terephthalate (melting point 255° C., softening point 240° C.) containing 100-% terephthalic acid as an acid component was used as a sheath, was spun at a core/sheath ratio (volume ratio) of 1:1 to form a yarn of 50 d/12 f. This yarn was interlaced, and then wound up. Subsequently, a single covering yarn was produced under the conditions shown in the following table using a urethane elastic yarn of 20 d as a core yarn and the above-mentioned composite yarn as a sheath yarn.

TABLE 3

| | |
|---|---|
| Number of rotations of a hollow spindle | 25,000 rpm |
| Draft of an elastic yarn | 3.0 times |
| Twist number | 1,000 T/M |

A tricot knitted fabric was produced using the above-mentioned covering yarn in a usual manner.

EXAMPLE 5

Method for producing a combined finished yarn: A core-sheath composite fiber wherein copolyethylene terephthalate containing isophthalic acid occupying 25 mol % of an acid component and having a softening point of 197° C. with substantially no melting point as measured by DSC was used as a core and polyethylene terephthalate (melting point 255° C., softening point 240° C.) containing 100-% terephthalic acid as an acid component was used as a sheath, was spun at a core/sheath ratio (volume ratio) of 1:1 to obtain a yarn of 30 d/10 f. A combined finished yarn was formed under the conditions shown in Table 4 using the above-mentioned composite yarn and a urethane elastic yarn of 20d.

TABLE 4

| | |
|---|---|
| Draft of an elastic yarn | 3.0 times |
| Twist number | 5,000 T/M |
| Yarn speed | 300 m/min |
| Treatment temperature | 160° C. |

A tricot knitted fabric was produced in a usual manner using the above-mentioned combined yarn.

The elastic knitted fabric produced by the method in each of Examples 3 to 5 was calendered at a heating temperature of 170° C. and a pressure of 700 mmH2O, and the section and the surface of the resulting fabric was observed using an electron microscope. The section of the composite yarn constituting the thus-obtained fabric was changed into a flat shape, and the interstices of the fabric were filled, providing an excellent surface smoothness. Further from the photograph of the plane surface, it was found that the core-sheath structure of the composite yarn was maintained, the core component was not exposed outside, and the composite yarns were not fused with each other. Accordingly, the texture of the fabric was not impaired in spite of the water resistance. Further, since calendering could be conducted at a low temperature, the properties of the urethane elastic yarn were not impaired by the heat treatment. Further, the fabrics obtained in Examples 3 to 5 all showed a water resistance of 30.0 cm or more. Thus, the good water resistance was shown.

(3) Description of a Pleated Fabric

A pleated fabric obtained by using a shape stability of an amorphous inverted core-sheath composite yarn is described below.

The amorphous inverted core-sheath composite yarn is used in the whole or a part of a warp group and/or a weft group constituting a fabric. When the composite yarn is used only in the warp group or the weft group, the ratio is relatively low. Even in this case, it is used at a ratio of 25% (weight ratio). When it is less than 25%, a shape stability is poor, making it impossible to achieve the object of the present invention. The warp group or the weft group is naturally arranged uniformly, and a combined weave is substantially preferable.

Thus, a pleat form having parallel or nearly parallel pleat lines includes a cigarette pleat, a cartridge pleat and a hurricane pleat. A pleat in which pleat lines are partially not parallel but are parallel as a whole includes a majolica pleat and an irregular pleat. In any pleated fabric in which pleat lines are nearly parallel to the warp group on the basis of the axial line or the fold line formed, it is important that the amount (weight ratio) of the amorphous inverted core-sheath composite yarn occupied in the weft group is at least equal to or preferably larger than the amount (weight ratio) of the amorphous inverted core-sheath composite yarn in the warp group.

In the fabric in which these lines are nearly parallel to the weft group on the basis of the axial line or the fold line, it is important that the amount (weight ratio) of the amorphous inverted core-sheath composite yarn occupied in the warp group is at least equal to or preferably larger than the amount (weight ratio) of the amorphous inverted core-sheath composite yarn in the weft group.

In the present invention, the characteristics of the amorphous inverted core-sheath composite yarn (single yarn) are used well, and this is mainly arranged in the warp or weft group to adapt to the pleat lines to increase a degree of retention of pleats formed in a woven fabric.

In a fabric in which specific amounts of filament yarns in the warp and weft groups are arranged nearly equally, a good durability is obtained even if pleat lines are directed in either a warp direction or a weft direction. As stated earlier, however, it is advisable that specific filament yarns are mainly arranged to adapt to the pleat lines.

Examples of the filament yarn to be combined with a mono- or multi-filament yarn formed of an amorphous inverted core-sheath composite yarn include a mono- or multi-filament yarn of a polyamide filament or a polyester filament which is ordinarily used in a fabric, and a finished yarn thereof.

EXAMPLE 6

A core-sheath composite fiber wherein copolyethylene terephthalate containing isophthalic acid (IPA) occupying 25 mol % of an acid component and having a softening point of 150° C. with substantially no melting point peak as measured by differential thermal analysis (DSC) of conducting heating in a nitrogen atmosphere at a rate of temperature rise of 10° C./min was used as a core and polyethylene terephthalate (melting point 255° C., softening point 240° C.) containing 100-% terephthalic acid as an acid component was used as a sheath, was spun at a core/sheath ratio (volume ratio) of 1:1 to form what the present invention terms a specific filament yarn of 50 d/12 f.

The above-mentioned specific filament yarn of 50 d/12 f (a6) and a regular polyester yarn (b6) of 50 d/12 f were used as a weft, and a mixing ratio of a yarn A and a yarn B in the weft was variously changed as mentioned below, while a regular polyester yarn (c6) of 50 d/12 f was used as a warp. Thus, a taffeta containing 113 yarns/inch as a warp and 103 yarns/inch as formed, and the following 7 types of fabrics were produced.

| Fabric No. | Item | Weft | Warp |
|---|---|---|---|
| 1 | Example | a6 yarn 100% (10 yarns of 10 yarns) | c6 yarn 100% |
| 2 | Example | a6 yarn 50% (1 yarn of 2 yarns) | c6 yarn 100% |
| 3 | Example | a6 yarn 30% (3 yarns of 10 yarns) | c6 yarn 100% |
| 4 | Example | a6 yarn 25% (1 yarns of 4 yarns) | c6 yarn 100% |
| 5 | Comparative Example | a6 yarn 20% (2 yarns of 10 yarns) | c6 yarn 100% |
| 6 | Comparative Example | a6 yarn 10% (1 yarn of 10 yarns) | c6 yarn 100% |
| 7 | Comparative Exampte | b6 yarn 100% | c6 yarn 100% |

Each of the fabrics was subjected to the same dyeing and antistatic treatment, then pleated using a crystal machine, and further subjected to dry heat treatment. Subsequently, the thus-treated fabrics were subjected or not subjected to wet heat steam setting. A test for a durability was then conducted. The results are shown in Table 5.

TABLE 5

| Fabric No. | Item | Setting of a raw fabric | Dipping method % | Dipping method grade |
|---|---|---|---|---|
| 1 | Example | yes | −5.2 | 5 |
| | | no | −1.6 | 5 |
| 2 | " | yes | −2.8 | 5 |
| | | no | −0.9 | 5 |
| 3 | " | yes | −1.3 | 5 |
| | | no | −0.3 | 4 ~ 5 |
| 4 | " | yes | −0.8 | 4 ~ 5 |
| | | no | 1.2 | 4 |
| 5 | Comparative | yes | 1.5 | 4 |
| | Example | no | 4.2 | 3 ~ 4 |
| 6 | Comparative | yes | 5.2 | 3 ~ 4 |
| | Example | no | 11.9 | 3 ~ 4 |
| 7 | Comparative | yes | 8.4 | 3 ~ 4 |
| | Example | no | 16.8 | 3 |

In Table 5, yes or no of setting means whether the above-mentioned steam setting is conducted or not. The dipping method is a method in which a pleated fabric is dipped in hot water, and the residual angle of the fold is visually observed. Specifically, a pleaded fabric or product is dipped in hot water of 70° C. containing a 0.2-% nonionic penetrating agent for 30 minutes, and then dried with air or using a drier. Subsequently, the folds are opened on a press after the drying, and the fabric or product in this state is steamed for 30 seconds. Thereafter, the pleat state is compared with that before dipping. Or, the folds are estimated using a remaining fold measuring device called "Crease Master". In this Example, the former was used.

The grades are as follows. Grade 5 . . . Folds are exactly in the same state before and after dipping. Grade 4 . . . The height of the fold after dipping is lower than that before dipping. Grade 3 . . . The head of the fold disappears, and only the fold line remains. Grade 2 . . . The fold line slightly remains. Grade 1 . . . The fold completely disappears. In the art, Grades 3 and 4 are deemed acceptable.

In the above-mentioned column "Dipping method", % indicates an elongation given when the fabric is placed horizontally, and minus (−) means a shrunk state as compared with a state before measurement.

As shown in the above-mentioned Example, the fabric according to the present invention can improve the shape retention by 1 or 2 grades owing to the properties provided by the fabric although subjected to the same pleating.

(4) Description of an Artificial Flower

An artificial flower obtained by using an amorphous inverted core-sheath composite yarn is described below.

In the present invention, a core component of an amorphous inverted core-sheath composite yarn used as a fabric material of an artificial flower is preferably an olefinic polymer besides the above-mentioned copolyester. For example, polyethylene, polypropylene or a copolymer of ethylene and propylene is preferable.

The sheath component of the amorphous inverted core-sheath composite yarn is preferably polyethylene terephthalate, 6-nylon or 6,6-nylon. It is not necessarily limited thereto. Other polyester or polyamide components are available.

With respect to the fabric material of the artificial flower, it is advisable to use a fabric containing at least 10% by volume of the above-described amorphous inverted core-sheath composite yarn. When the amount is less than 10% by volume, the shape stability is hardly obtained, and it is undesirous. As the other component to be mixed, a polyester or nylon having a softening point of 220° C. or more is preferable.

With respect to a method for making an artificial flower of the present invention, for example, the above-mentioned fabric is used as a material, subjected to a usual refining step without conducting melamine resin coating, then printed, cut and heat-pressed for forming a pattern to obtain a desired artificial flower. However, the method is not necessarily limited thereto.

Since the amorphous inverted core-sheath composite yarn is used in an amount of at least 10% by volume in the artificial flower of the present invention, a good shape stability can easily be provided. Further, the thickness of the material and the delicate hardness thereof given when it is touched with hands can be controlled well by the thickness of the raw yarn, the filament number, the volume ratio of the core and the sheath, and the ratio of the amorphous inverted core-sheath composite yarn. Further, since the coating of the melamine resin is not needed, the problems such as fusion of the material by heat-pressing, occurrence of an offensive odor and the like are not posed, and the procedure can be shortened.

EXAMPLE 7

Example of the present invention is specifically described below. The following three types of raw yarns were prepared.

Raw yarn (a7): A core-sheath composite fiber wherein copolyethylene terephthalate containing isophthalic acid (IPA) occupying 25 mol % of an acid component and having a softening point of approximately 150° C. with substantially no melting point as measured by DSC was used as a core and polyethylene terephthalate (melting point 255° C., softening point 240° C.) containing 100-% terephthalic acid as an acid component was used as a sheath, was spun at a core/sheath ratio (volume ratio) of 1:1 to form a yarn of 50 d/12 f.

Raw yarn (b7): Regular polyester yarn of 50 d/12 f in which 100-% terephthalic acid was used as an acid component.

Raw yarn (c7): same as the raw yarn (B7)

Each of these raw yarns (a7, b7 and c7) was used as a weft, and a regular polyester yarn of 50 d/48 f containing 100-% terephthalic acid as an acid component was used as a warp.

Plain weave fabrics (A7, B7, C7) were produced such that densities of a warp and a weft as finished were 175 yarns/inch and 105 yarns/inch, respectively. The resulting fabrics were refined by the same step under the same conditions as in obtaining an ordinary polyester plain weave fabric. The plain fabric (A7) is an example of the present invention in which the raw yarn (a7) corresponding to the amorphous inverted core-sheath composite yarn was used as a weft. The plain weave fabrics (B7, C7) were both the same comparative samples free from the amorphous inverted core-sheath composite yarn. At this stage, only the plain weave fabric (C7) was subjected to melamine resin finishing. Then, the fabric was dyed with quite a light purple, printed for partial coloration, and cut according to a main pedal of an orchid to give 10 pieces of this main pedal. A silicone oil releasing agent was sprayed only to the fabric (C7) subjected to melamine resin finishing.

Further, the 10 pieces were overlaid at 205° C., and the pedals were roughened or warped using a frame press. Finally, water repellent finishing was conducted using a fluorine-type water repellent to obtain three main pedals (Af7, Bf7, Cf7) of an artificial orchid flower, each consisting 10 pieces.

The artificial flower (Af7) made by the method of the present invention had tension and stiffness, was excellent in a shape stability, touched soft, and was, at a glance, like a natural flower. Meanwhile, the artificial flower (Bf7) was insufficient in tension and stiffness, and had an instable shape retention. Further, in the artificial flower (Cf7), pedals were liable to stick to each other after the heat pressing, and this flower was also problematic in the offensive odor.

(5) Description of a Wig

An example in which an amorphous inverted core-sheath composite yarn was used in a wig was described.

Such a wig is a wig consisting of a base net capable of covering the head skin, a plurality of artificial hairs implanted in this base net to be protruded outside, and a coating body mounted integrally on the inside of the base net, characterized in that an amorphous inverted core-sheath composite yarn is used in the above-mentioned artificial hairs.

In the wig of the present invention, at least the artificial hairs are formed of the amorphous inverted core-sheath composite yarn, and the base net is formed of a regular filament yarn. A plurality of artificial hairs are implanted in the base net, and the coating body is sewed on the inside of the base net as required.

The regular filament of the filament yarn forming the base net is preferably a polymer constituting the sheath component of the amorphous inverted core-sheath composite yarn, and this filament is spun to obtain a regular filament.

In the present invention, the amorphous inverted core-sheath composite yarn is used in the artificial hairs. The shape can easily be applied to the artificial hairs by heat-setting the same at a temperature which is higher than a softening point of a core component and lower than softening point of a sheath component, and this shape can be retained stably. Further, the shape can be changed repeatedly through heat-setting. It is possible to use a composite multifilament yarn in a base net. However, this has no special merit, and it is ordinarily not used.

EXAMPLE 8

Example of the present invention shown in the drawings is described specifically. FIGS. 1 to 4 show an working example of a wig X in the present invention.

1 is a base net capable of covering the head skin, and this base net 1 consists of a peripheral end portion 1*a* sewed on a circular cloth and a flocking portion 1*b* which is formed into a cap so as to be able to cover the head skin from this peripheral end portion 1*a*.

In this Example, a polymer b which was a component of a regular filament of a filament yarn used to form the base net was polyethylene terephthalate (melting point 255° C., softening point 240° C.) containing 100-% terephthalic acid as an acid component. This was spun to form a regular filament, and a raw yarn of 480 d/12 f was formed upon using this regular filament. The raw yarn was wound into a hank, then dyed, and knitted to obtain the base net 1.

2 is a plurality of artificial hairs 2 which are implanted to be protruded outside on the flocking portion 1*b* of the base net 1. In this Example, with respect to the components of the composite filament of the filament yarn used to form the artificial hairs 2, the core component is a polymer a, and the sheath component is a polymer b.

More specifically, first in Example 8, copolyethylene terephthalate in which isophthalic acid occupied 25 mol % of an acid component and which had a softening point of approximately 150° C. with substantially no melting point peak as measured by DSC was used as a polymer a or as a core component, and polyethylene terephthalate used in the above-mentioned regular filament was used as a polymer b or as a sheath component. Two types of core-sheath composite filaments different in thickness were spun at a core/sheath volume ratio of 1/1. A yarn of 800 d/16 f and a yarn of 560 d/12 f were formed using the same, and subjected to hank dyeing. Two types of artificial hairs 2 (A8, B8) were obtained using these two types of the yarns.

In the next Example, polypropylene having a softening point of approximately 155° C. was used as a polymer a or as a core component, and a color material obtained by mixing 6-nylon having a softening point of approximately 230° C. with pigments, carbon black, red oxide and titanium yellow was used as a polymer b or as a sheath component. Two types of core-sheath composite filaments different in thickness were spun at a core/sheath volume ratio of 1/2. A yarn of 720 d/16 f and a yarn of 600 d/12 f were formed using the same. Two types of artificial hairs 2 (C8, D8) were obtained using these two types of the yarns.

3 is a coating body mounted integrally on the inside of the flocking portion 1*b* of the base net 1. In this coating body 3, a synthetic resin material and a rubber material such as a natural rubber, a synthetic rubber or the like were used as materials. These materials were dissolved in a solvent to form a liquid coating, and this was cast into a desired mold to obtain a tape-like coating body 3.

The above-mentioned base net 1 and coating body 3 were used in Examples 1 and 2. Four types of wigs (A8, B8, C8, D8) according to the present invention were obtained using the two types of the artificial hairs 2 (A8, B8) in Example 1 and the two types of the artificial hairs 2 (C8, D8) in Example 2.

The wigs (A8, B8, C8, D8) according to the present invention and a wig produced by a method disclosed in Japanese Patent Laid-Open No. 173,106/1994 were subjected to comparison tests with respect to easiness in hair style setting (using a hot curler having a surface temperature of 150° C.), a durability of a hair style and repetitiveness of hair style setting. As a result, the wigs according to the present invention were clearly excellent in all of these tests.

Further, the relationship between the hair style setting temperature and the setting effect was tested and evaluated by the following methods (1) to (4) using the above-mentioned wig (b).

(1) The hair was wound on a curler having a surface temperature of 83° C., and allowed to stand for 30 minutes. (X)

(2) The hair wound on the curler was heated in an oven at 120° C. for 10 minutes. (○)

(3) The hair was set in a position spaced apart by 5 cm from a jet port of a hair drier (120 to 150° C.). (○)

(4) The hair was set for 5 seconds using a commercial hot curler. (○)

In the evaluation method, the condition after the setting was visually observed, and evaluated from the feeling when the wig was actually used. (○) was satisfactory and (X) unsatisfactory, respectively. From the foregoing results, it is advisable that the setting is conducted at 120° C. or higher to obtain a good setting property.

Figure 3:
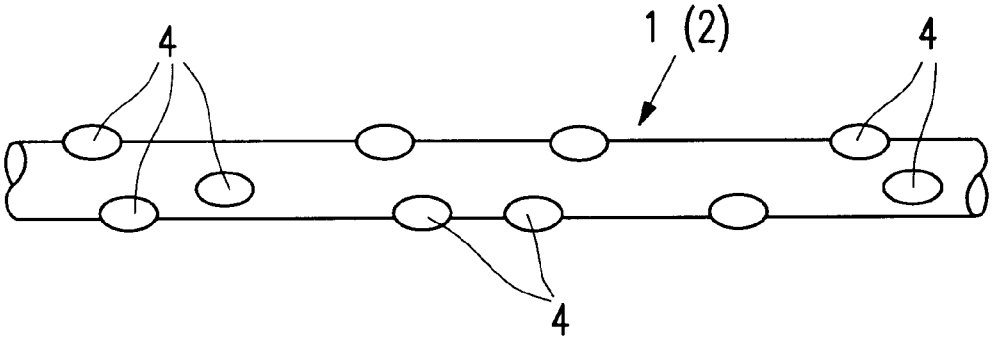
FIG. 3 is an enlarged view showing a surface of a regular or composite filament of the wig of the present invention which is used in another Example.
Figure 4:
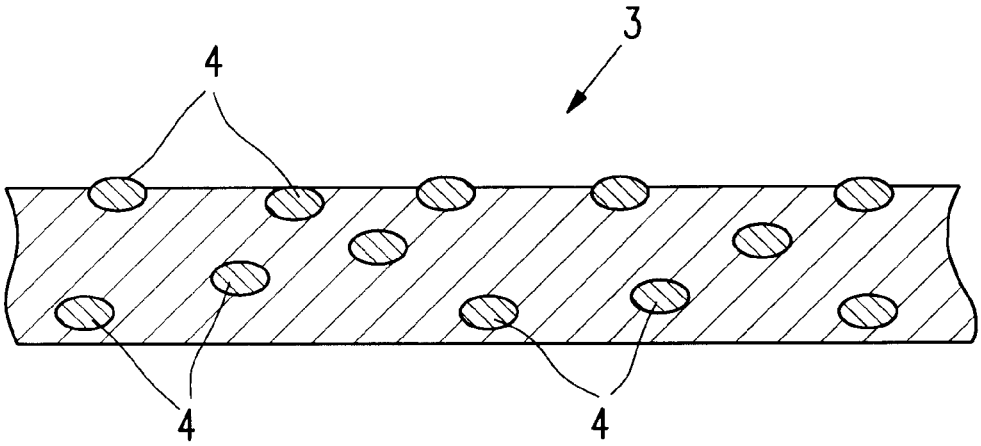
FIG. 4 is an enlarged sectional view showing a section of a coating body of the wig of the present invention which is used in still another Example.

In a working example other than the above-mentioned, the above-mentioned base net 1, artificial hairs 2 and coating body 3 can be mixed with an antimicrobial fine powder 4 such as a zeolite fine powder or an inorganic fine powder. At that time, the antimicrobial fine powder 4 is included in the base net 1, the artificial hairs 2 and the coating body 3. In some product, the fine powder is exposed to the outer surface of the base net, the artificial hairs and the coating body as shown in FIGS. 3 and 4.

In still another working example, the above-mentioned artificial hairs 2 can be mixed with zirconium carbide and one or more of zinc, silver and copper in order to exhibit a color depth and a weatherability.

(6) Amorphous Inverted Core-Sheath Composite Yarn is used in the Outside

A combined filament yarn having a different shrinkage, a cohesive bulky yarn and a slub yarn (hereinafter referred to as "composite yarns") obtained by using an amorphous inverted core-sheath composite yarn is described below.

Each of these composite yarns is a yarn consisting of high and low multifilaments which are different in a boiling water shrinkage or a residual elongation. The multifilament having a low shrinkage is naturally situated on the outside of the yarn through shrinking after mixing the filaments. In the slub yarn and the spandex, the wound yarn forms the outside of the composite yarn.

In this composite yarn, the amorphous inverted core-sheath composite yarn is previously used in the multifilament situated on the outside of the yarn after the treatment to impart a water resistance and a shape stability to the overall yarn.

Thus, when the intended yarn is the combined filament yarn having the different shrinkage, the cohesive bulky yarn or the slub yarn, the multifilament of the thermoplastic synthetic fiber to be combined with the amorphous inverted core-sheath composite yarn is formed of a polyamide, a polyester, a polyolefin or the like of a regular type having a fiber formability.

In addition, the structure of each yarn is specifically described. In the case of the combined filament yarn having the different shrinkage, the amorphous inverted core-sheath composite yarn is used as a multifilament having a low boiling water shrinkage of approximately 8%. The regular type multifilament is used as a multifilament having a high boiling water shrinkage of approximately 20%. The fluid intermingling step of these two may be a false-twisting step in which spinning and drawing are conducted in this order or a direct spinning-drawing step.

In this combined filament yarn having the different shrinkage, the fiber having the low boiling water shrinkage (amorphous inverted core-sheath composite yarn) forms the outside of the yarn.

Then, this is heat-set under increased pressure to impart a shape stability to the low-shrinkage component (amorphous inverted core-sheath composite yarn), and the bulky condition is maintained stably.

Likewise, in the cohesive bulky yarn, the amorphous inverted core-sheath composite yarn is used as a finished yarn having a high elongation. The other structural yarn is used as a finished yarn having a low elongation. The difference between both elongations is 50% or higher. As a result, when a final product is formed, the amorphous inverted core-sheath composite yarn situated on the outside of the composite yarn has the shape stability and is swollen, with the result that the bulky form is stably maintained in the overall fabric and it is less flattened.

In the slub yarn, the amorphous inverted core-sheath composite yarn is used as a sheath yarn, and the regular type multifilament is used as a core yarn, whereby the shape stability of the single spiral portion or the multi-spiral portion formed by the sheath yarn becomes excellent and the slub portion is stably secured without being loosened.

In the composite yarns consisting of a combination of monofilaments or multifilaments of plural thermoplastic synthetic fibers, such as the combined filament yarn having the different shrinkage, the cohesive bulky yarn, the slub yarn, the spandex and the covering yarn, the amorphous inverted core-sheath composite yarn is used in the multifilament situated on the outside of the yarn as mentioned above, whereby the high shape stability and the high water resistance are imparted to the fibrous structures such as woven and knitted fabrics, yarns and the like which are obtained by using the above-mentioned composite yarn.

EXAMPLE 9

Example is specifically described. A hydraulic pressure resistance in Example is measured according to a JIS L-1092A method (hydrostatic method).

Further, with respect to a shape stability, a sample is wound on a glass tube 10 mm in diameter, heat-set, and cooled. A load of 100 g/cm$^2$ is put on the sample which is open, and is removed after 5 minutes. At this time, the wound condition is visually estimated. In the test results, ○ is good, Δ is common, and X is bad.

A half-drawn high-shrinkage filament of 50 d/24 f having a boiling water shrinkage of 20.0% which filament was obtained by using a polyethylene terephthalate resin having an intrinsic viscosity of 0.64 as a starting material and subjecting the same to steps of spinning, drawing and heat-setting, and a core-sheath drawn low-shrinkage composite filament of 50 d/24 f having a core-sheath ratio (volume ratio) of 1:1 and a boiling water shrinkage of 8.0% in which copolyethylene terephthalate containing isophthalic acid occupying 25 mol % of an acid component and having a softening point of approximately 150° C. with substantially no melting point peak as measured by DSC was used as a core and polyethylene terephthalate containing 100-% terephthalic acid as an acid component (melting point 255° C., softening point 240° C.) was used as a sheath, were spun, then joined, simultaneously penetrated through an interlace nozzle, subjected to fluid intermingling for combination, and wound up on a bobbin.

A plain weave fabric was produced by using this combined filament yarn as a weft and a regular polyester raw yarn of 50 d/48 f containing 100-% terephthalic acid as an acid component as a warp to obtain a fabric of Example 9.

On the other hand, a half-drawn high-shrinkage filament of 50 d/18 f containing a 100-% regular polyester and having a boiling water shrinkage of 20.0% and a low-shrinkage filament of 50/18 f containing the same polyester and having a boiling water shrinkage of 8.0% were spun, joined, penetrated through an interlace nozzle under the same conditions as in Example 1, subjected to fluid intermingling for combination, and wound up on a bobbin.

A plain weave fabric was produced by using this combined filament yarn as a weft and a regular polyester raw yarn of 50 d/48 f containing 100-% terephthalic acid as an acid component as a warp to obtain a fabric of Comparative Example 1.

The fabrics of Example 9 and Comparative example 1 were heat-treated (calendered) at 170° C. and a pressure of 35 kg/cm$^2$, and a hydraulic pressure resistance and a shape stability of these fabrics were measured. The results are shown in Table 6.

TABLE 6

| Type of a fabric | Test for water resistance: Calendering temperature | Test for water resistance: Hydraulic pressure resistance (cm) | Test for shape stability: Heat treatment temperature | Test for shape stability: Stability |
|---|---|---|---|---|
| Example 9 | 170° C. | 100 or more | 140° C. | Δ |
| | | | 170° C. | ○ |
| Comparative Example 1 | 170° C. | 60 | 140° C. | x |
| | | | 170° C. | x |

EXAMPLE 10

A core-sheath composite half-drawn yarn (108 d/36 f) having a residual elongation of 150% which was obtained by conducting spinning, drawing and heat-setting at a core-sheath ratio (volume ratio) of 1:1 and in which copolyethylene terephthalate containing isophthalic acid occupying 25 mol % of an acid component and having a softening point of approximately 150° C. with substantially no melting point peak as measured by DSC was used as a core and polyethylene terephthalate (melting point 255° C., softening point 240° C.) containing 100-% terephthalic acid as an acid component was used as a core, was used as a polyester drawn yarn. This yarn was combined with a polyester drawn yarn (residual elongation 30%). This combined yarn was formed into a false-twisted yarn under the following conditions. A plain weave fabric was formed using this false-twisted yarn as a warp and a weft to obtain a fabric of Example 10.

| False-twisting conditions | |
|---|---|
| Number of spindle rotations: | 250,000 R/M |
| Twist number: | 2,530 T/M |
| Heater temperature: | 180° C. |
| Feed ratio: | −5% |
| Take-up ratio: | +6.2% |

Meanwhile, a regular polyester drawn yarn (108 d/36 f) and a regular polyester undrawn yarn (108 d/36 f) were combined, and false-twisted under the same conditions as in Example 2 to obtain a false-twisted yarn.

A plain weave fabric was produced by using this false-twisted yarn as a warp and a weft to obtain a fabric of Comparative Example 2.

The fabrics of Example 10 and Comparative Example 2 were heat-treated (calendered) at 170° C. and a pressure of 35 kg/cm$^2$, and then measured for a hydraulic pressure resistance and a shape stability. The results are shown in Table 7.

TABLE 7

| Type of a fabric | Test for water resistance: Calendering temperature | Test for water resistance: Hydraulic pressure resistance (cm) | Test for shape stability: Heat treatment temperature | Test for shape stability: Stability |
|---|---|---|---|---|
| Example 10 | 170° C. | 95 | 140° C. | { |
| | | | 170° C. | ○ |
| Comparative Example 2 | 170° C. | 60 | 140° C. | x |
| | | | 170° C. | x |

EXAMPLE 11

A polyester drawn yarn of 50 d/48 f was used as a synthetic fiber multifilament yarn which was a core yarn, and a core-sheath composite yarn (50 d/48 f) having a core-sheath ratio (volume ratio) of 1:1 in which copolyethylene terephthalate containing isophthalic acid occupying 25 mol % of an acid component and having a softening point of approximately 150° C. with substantially no melting point peak as measured by DSC was used as a core component, and polyethylene terephthalate (melting point 255° C., softening point 240° C.) containing 100-% terephthalic acid as an acid component was used as a sheath component was used as a sheath yarn. These yarns and the above-mentioned drawn yarn were subjected to ordinary false-twisting under the following conditions to obtain a raw yarn of a slub yarn.

The raw yarn of the slub yarn was heat-treated at 170° C. to fix the sheath yarn, and then wound up to complete the slub yarn. In this slub yarn, the sheath portion was not moved at all in weaving, and the product was excellent in an appearance and a texture, and different from the conventional product.

| False-twisting conditions | |
|---|---|
| Number of spindle rotations: | 185,500 R/M |
| Twist number: | 3,040 T/M |
| Heater temperature: | 200° C. |
| False-twisting feed ratio: | −3.1% |
| Take-up ratio: | +6.2% |
| Tension of a wound yarn: | 0 ~ 1 g/d |

EXAMPLE 12

A polyester drawn yarn of 62 d/48 f having a boiling point shrinkage of 20% was used as a core yarn, and a polyester half-drawn yarn of 50 d/48 f having a boiling point shrinkage of 8% was used as a sheath yarn. These yarns were false-twisted to form a yarn having a core-sheath structure.

The sheath portion of this yarn was robbed, and a slub was intermittently formed on the core yarn through yarn rubbing. Further, a half-drawn yarn having a core-sheath composite yarn at a core-sheath ratio (volume ratio) of 1:1 in which copolyethylene terephthalate containing isophthalic acid occupying 25 mol % of an acid component and having a softening point of approximately 150° C. with substantially no melting point peak as measured by DSC was used as a core component and polyethylene terephthalate (melting point 255° C., softening point 240° C.) containing 100-% terephthalic acid as an acid component was used as a sheath component, was wound on an outer periphery of the above-obtained yarn to give a raw yarn of a slub yarn. The above-mentioned core-sheath composite yarn was wound in order to fix the sheath yarn of the slub-containing yarn on the core yarn.

This raw yarn of the slub yarn was heat-treated at 170° C. to fix the core-sheath composite yarn and then wound up to complete the slub yarn. Since the core-sheath composite yarn of this slub yarn had the shape stability, the slub portion was not loosened at all. This slub yarn could form the fabric surface according to the design and was quite useful.

(7) Description of a Composite Yarn Obtained by Using an Amorphous Inverted Core-Sheath Composite Yarn in the Inside A composite yarn obtained by using an amorphous inverted core-sheath composite yarn in the inside, such as a combined filament yarn having a different shrinkage, a bulky finished yarn, a slub yarn, a ring yarn, a braid yarn or the other design yarn is described.

The other fiber to be combined with the amorphous inverted core-sheath composite yarn is at least one fiber selected from the group consisting of thermoplastic synthetic fibers of a polyester, a polyamide, a polyolefin and the like, natural fibers of cotton, silk, wool and the like, and artificial fibers of rayon, acetate and the like.

When the composite yarn is a combined filament yarn having a different shrinkage, it is two or more yarns having a different boiling water shrinkage which are selected from thermoplastic synthetic fibers of a polyester, a polyamide, a polyolefin and the like, natural fibers of cotton, silk, wool and the like and artificial fibers of rayon, acetate and the like. A high-shrinkage yarn is situated in the inside of the yarn by the shrink treatment after the yarn combination. Accordingly, the amorphous inverted core-sheath composite yarn is used as a high-shrinkage yarn. Further, a bulky finished yarn comprises two or more yarns having an elongation difference which are selected from thermoplastic synthetic yarns of a polyester, a polyamide, a polyolefin and the like, natural fibers of cotton, silk, wool and the like, and artificial fibers of rayon, acetate and the like. The low-elongation finished yarn is situated in the inside of the yarn by the false-twisting after the combination. Thus, the amorphous inverted core-sheath composite yarn is used as a low-elongation finished yarn. Further, in a slub yarn, a core yarn naturally forms the inside of the yarn, and the amorphous inverted core-sheath composite yarn is therefore used as a core yarn.

That is, in the composite yarn, the amorphous inverted core-sheath composite yarn is used as a yarn situated in the inside of the composite yarn to impart a high shape stability.

In addition, the structure of each composite yarn is described more specifically. First, in the case of the combined filament yarn having the different shrinkage, the above-mentioned amorphous inverted core-sheath composite yarn is used as a yarn of a high boiling water shrinkage having a boiling water shrinkage of from 10 to 30%. The other structural yarn is used as a yarn of a low boiling water shrinkage having a boiling water shrinkage of from 0 to 15%, and the amorphous inverted core-sheath composite yarn and the other structural yarn are selected to have a difference in a shrinkage of 5% or more, preferably 10% or more. The fluid intermingling may be conducted during a spinning step, during a drawing step, during a combining step after that or directly during spinning and drawing steps.

In this combined filament yarn having the different shrinkage, a fiber (amorphous inverted core-sheath composite yarn) having a high boiling water shrinkage is mainly situated in the inside of the yarn by boiling water-shrinking treatment after forming a woven or knitted fabric. Then, this yarn is heat-set whereby a high-shrinkage component (amorphous inverted core-sheath composite yarn) comes to have the shape stability as stated above. Accordingly, properties of the low-shrinkage fiber, such as a swelling property and the like, are not impaired while retaining the shape stability.

Next, in the bulky finished yarn, the amorphous inverted core-sheath composite yarn is used as a low-elongation finished yarn. The other structural yarn is used as a high-elongation finished yarn. A difference in elongation therebetween is 50% or more. As a result, when a final product is formed using this yarn, the amorphous inverted core-sheath composite yarn situated in the inside of the composite yarn maintains the shape stability, and the other structural yarn situated outside is swollen, so that the overall composite yarn has a bulky shape and is excellent in a texture.

In the slub yarn, the amorphous inverted core-sheath composite yarn is used as a core yarn, and the other structural yarn is used as a sheath yarn, whereby the overall fabric has an excellent shape stability and the appearance and the texture inherent in the slub yarn are not lost.

In order to exhibit the shape stability using the composite yarn of the present invention, it is advisable that the composite yarn is used at a ratio of at least 30%, preferably at least 50%. Further, when a fabric is pleated in a warp or weft direction, it is advisable that the composite yarn is used at a ratio of at lest 25%, preferably at least 30%, more preferably at least 40% of a yarn intersected with a pleat line.

EXAMPLE 13

A core-sheath composite filament of 50 d/24 f having a core-sheath ratio (volume ratio) of 1:1 and a boiling water shrinkage of 21.0% in which copolyethylene terephthalate containing isophthalic acid occupying 25 mol % of an acid component and having a softening point of approximately 150° C. with substantially no melting point peak as measured by DSC was used as a core component and polyethylene terephthalate (melting point 255° C., softening point 240° C.) containing 100-% terephthalic acid as an acid component, and a (drawn) low-shrinkage filament having a boiling water shrinkage of 8.0% and composed of polyethylene terephthalate having an intrinsic viscosity of 0.64 were drawn, then joined, passed through an interlace nozzle at the same time, subjected to fluid intermingling for combination, and wound up on a bobbin. This combined filament yarn was used as a weft, and a regular polyester raw yarn of 50 d/48 f containing 100-% terephthalic acid as an acid component was used as a warp. A plain weave fabric having a warp density of 110 yarns/inch and a weft density of 80 yarns/inch was produced using the above-mentioned yarns to obtain a fabric of Example 13.

On the other hand, a yarn was formed under the same conditions as in Example 13 except that a regular polyester yarn of 50 f/24 d having a boiling water shrinkage of 22% was used instead of the core-sheath composite filament in Example 13, and combined with a weft to obtain a fabric of Comparative Example 3.

The fabrics of Example 13 and Comparative Example 3 were subjected to the dyeing and finishing of an ordinary polyester fabric, and then heat-set for imparting a shape stability. The shape stability of each fabric was measured. The results are shown in Table 8.

TABLE 8

| | Test for a shape stability | |
|---|---|---|
| Type of a fabric | Heat treatment temperature | Stability |
| Example 13 | 140° C. | Δ |
| | 170° C. | ○ |
| | 200° C. | ○ |
| Comparative Example 3 | 140° C. | x |
| | 170° C. | x |
| | 200° C. | x ~ Δ |

EXAMPLE 14

A drawn core-sheath composite yarn (75 d/36 f) having a core-sheath ratio (volume ratio) of 1:1 and a residual elongation of 32% in which copolyethylene terephthalate containing isophthalic acid occupying 25 mol % of an acid component and having a softening point of approximately 150° C. with substantially no melting point peak as measured by DSC was used as a core and polyethylene terephthalate containing 100-% terephthalic acid as an acid component was used as a sheath, and a half-drawn polyester yarn having a residual elongation of 121% were arranged in order, intermingled, and then false-twisted under the following conditions to form a bulky finished yarn of 200 d/73 f. A plain weave fabric was formed by using this finished yarn in both the warp and the weft to obtain a fabric of Example 14.

| False-twisting conditions | |
|---|---|
| Number of spindle rotations: | 258,000 R/M |
| Twist number: | 2,530 T/M |
| Heater temperature: | 180° C. |
| Feed ratio: | −5% |
| Take-up ratio: | +6.2% |

Meanwhile, a drawn regular polyester yarn (75 d/36 f) having a residual elongation of 28% and a half-drawn regular polyester yarn (115 d/36 f) were combined, and false-twisted under the same conditions as in Example 14 to obtain a false-twisted yarn of 200 d/72 f.

A plain weave fabric was produced by using this false-twisted yarn in both the warp and the weft to obtain a fabric of Comparative Example 4.

The fabrics of Example 14 and Comparative Example 4 were treated as in Example 13, and the shape stability thereof was measured. The results are shown in Table 9.

TABLE 9

| | Test for a shape stability | |
|---|---|---|
| Type of a fabric | Heat treatment temperature | Stability |
| Example 14 | 140° C. | Δ |
| | 170° C. | ○ |
| Comparative Example 4 | 140° C. | x |
| | 170° C. | x |

EXAMPLE 15

A core-sheath composite yarn (50 d/24 f) having a core-sheath ratio (volume ratio) of 1:1 in which copolyethylene terephthalate containing isophthalic acid occupying 25 mol % of an acid component and having a softening point of approximately 150° C. with substantially no melting point peak as measured by DSC was used as a core and polyethylene terephthalate (melting point 255° C., softening point 240° C.) containing 100-% terephthalic acid as an acid component was used as a sheath was used as a core yarn, and a drawn polyester yarn of 50 d/96 f was used as a sheath yarn. These yarns were subjected to usual false-twisting under the following conditions to obtain a false-twisted slub yarn of Example 15.

| False-twisting conditions | |
|---|---|
| Number of spindle rotations: | 185,500 R/M |
| Twist number: | 3,040 T/M |
| Heater temperature: | 200° C. |
| Overfeed ratio of a weft: | +50% |
| False-twisting feed ratio: | −3.1% |

-continued

| False-twisting conditions | |
|---|---|
| Take-up ratio: | +6.2% |
| Tension of a wound yarn: | 0 ~ 1 g/d |

Meanwhile, a slub yarn of Comparative Example 3 was produced under the same conditions as in Example 15 except that a polyethylene terephthalate yarn of 50 d/24 f containing 100-% terephthalic acid as an acid component was used as a core yarn instead of the core-sheath composite yarn.

The thus-obtained slub yarns of Example 15 and Comparative Example 4 were used as a warp, and combined with a weft of a satin fabric (5-satin, 3-pass) obtained by using an ordinary finished yarn of 75 d/36 f. In Example 15-1, the slub yarn produced by the above-mentioned method occupied 25% of the weft. In Example 15-2, the slub yarn occupied 50% thereof. Further, in Comparative Example 4, the slub yarn occupied 50% of the weft. This fabric was subjected to the ordinary polyester finishing, and the shape stability thereof was then measured. The results are shown in Table 10.

TABLE 10

| | Test for shape stability | | |
|---|---|---|---|
| Type of a fabric | Heat treatment temperature | Stability | Mixing ratio of a slub yarn (based on a weft) |
| Example 15-1 | 140° C. | Δ | 25% |
| | 170° C. | ○ | |
| Example 15-2 | 140° C. | ○ | 50% |
| | 170° C. | ◎ | |
| Comparative Example 4 | 140° C. | x | 50% |
| | 170° C. | x | |

(8) Description of an Embossed Fabric

Embossing of a fabric obtained by using an inverted core-sheath composite yarn or a normal core-sheath composite yarn in which a core component and a sheath component are replaced with each other is described.

A multifilament of which a structural single yarn is formed of an amorphous inverted core-sheath composite yarn is used in a part or the whole of a warp and/or a weft. When the multifilament is used only as a warp or a weft, the ratio thereof is the lowest. Even in such a case, it is used at a ratio of at least 30% thereof. When the ratio is less than 30%, a water resistance and a shape stability become poor, making it impossible to achieve the object of the present invention. The warp or the weft are naturally arranged uniformly, and intermingling is substantially preferable. The multifilament to be intermingled with the amorphous inverted core-sheath composite yarn includes a multifilament of an ordinary regular type polyamide filament or polyester filament, and a finished yarn thereof.

When a sum of textile cover factors [denier$^{0.5}$×count (yarns/inch) in warp and weft directions is defined as TCF, the TCF range has to be 800>TCF>2,500. When TCF is more than 2,500, a clear pattern hardly appears, and especially a form is hardly made clear. When TCF is less than 800, a durable fabric is hardly produced.

A fabric obtained by using the amorphous inverted core-sheath composite yarn is, after weaving, subjected to a refining step, a relaxation step using a liquid stream, a dying step which is conducted as required, a finishing step and the like in this order, and the thus-treated fabric is fed to an embossing calender.

In the ordinary embossing calender, a hard heat roll having a raised engraved pattern and a soft roll on a recessed side used in combination therewith are rotated while being pressed at an appropriate pressure. A fabric to be embossed is introduced between both the rolls to form an embossed pattern thereon. A difference in height between the above-mentioned raised and recessed portions has to be 1 mm or more. When it is less than 1 mm, it is deemed difficult to form a satisfactory raised and recessed pattern.

The fabric according to the present invention does not depend on the raised and recessed pattern of the fabric by the heat treatment, but the core component or the sheath component formed of a low-softening and amorphous polymer is pressed by a hard heat roll of an embossing machine, and the filament diameter thereof is changed and increased so that the raised pattern drawn on the heat roll is formed on the fabric.

In a device for producing the fabric of the present invention from the changed condition of the fabric in the above-mentioned embossing step, the difference in height between the raised and recessed portions for making a pattern is not so required. Accordingly, a pattern can easily be made by a mere combination of a hard heat roll having a raised pattern and a soft roll having a smooth surface. Usually, it is deemed that a pressure of the pair of the embossing rolls has to be approximately 10 kg/cm$^2$. However, the fabric of the present invention can be formed at a pressure of approximately 5 kg/cm$^2$.

One of the important finishing conditions to obtain the fabric of the present invention is a surface temperature of a hard heat roll having a pattern.

When a regular polyester fiber or a regular polyamide fiber is used as a sheath component of the amorphous inverted core-sheath composite yarn, an appropriate surface temperature is between 160 and 190° C. When a pressing time is 1 second or more, an embossed fabric which is excellent in a vividness and a durability can be produced.

Further, in this embossed fabric, a normal core-sheath composite yarn in which a core component and a sheath component are replaced with each other can also be used instead of the above-described amorphous inverted core-sheath composite yarn.

EXAMPLE 16

The following three types of raw yarns were prepared.

Raw yarn a16—A core-sheath composite fiber wherein copolyethylene terephthalate containing isophthalic acid (IPA) occupying 25 mol % of an acid component and having a softening point of approximately 150° C. with substantially no melting point peak as measured by DSC was used as a core and polyethylene terephthalate (melting point 255° C., softening point 240° C.) containing 100-% terephthalic acid as an acid component was used as a sheath, was spun at a core/sheath ratio (volume ratio) of 1:1 to form a yarn of 75 d/24 f.

Raw yarn b16—Yarn of 75 d/24 f in which the core component and the sheath component of the raw yarn a16 were inverted.

Raw yarn c16—Regular polyester yarn of 75 d/24 f in which 100-% terephthalic acid was used as an acid component.

These three types of the raw yarns were subjected to additional twisting with a twist number of 1,000 T/M to obtain test wefts. Meanwhile, a regular polyester of 75 d/36 f containing 100-% terephthalic acid as an acid component was subjected to additional twisting with a twist number of 1,000 T/M to form a test warp to be used in common.

The thus-obtained warp and weft were formed into a plain weave fabric having a warp density of 71 yarns/inch and a weft density of 75 yarns/inch. In this manner, test fabrics A, B and C were provided. These test fabrics were subjected to refining, relaxation in a liquid stream, preliminary setting at 190° C., dyeing at 130° C. and finish-setting at 160° C. to give fabrics A16, B16 and C16 for embossing.

These three raw fabrics A16, B16 and C16 were put on an embossing machine, and passed through a heat roll (170° C.) having a predetermined flower pattern and a soft rubber roll (room temperature) having a flat surface to obtain embossed fabrics. The contact pressure of both rolls was 5 kg/cm2, and the contact time was 1 second. The shape stabilities of these three fabrics immediately after the embossing and after 10 washings were tested, and the results are shown in Table 11. With respect to the shape stability, the test fabric was wound on a glass tube having a diameter of 10 mm, heat-set, and cooled. A load of 100 g/cm2 was put on the thus-treated test fabric which was open, and removed after 5 minutes. At this time, the wound condition and the residual state of the flower pattern were visually observed.

TABLE 11

| Type of a fabric | Fabric A16 | | Fabric B1 6 | | Fabric C16 | |
|---|---|---|---|---|---|---|
| Raw yarn used in a weft | Raw yarn a16 | | Raw yarn b16 | | Comparative Example Regular polyester | |
| Texture of a product | good | | slightly hard | | common | |
| Condition of a flower pattern | good | | slightly vivid | | good | |
| Number of washings | 0 | 10 | 0 | 10 | 0 | 10 |
| Shape stability | ◎ | ◎ | ○ | ○ | Δ | x |
| Condition of a pattern | ◎ | ◎ | ◎ | ◎ | x | x |

In the present invention, a textile cover factor in a warp direction indicates a subduplicate of a warp density (yarns/inch)×(warp denier)$^{0.5}$, and a textile cover factor in a weft direction indicates a subduplicate of a weft density (yarns/inch)×weft denier. TCF defined in the present invention is a sum of the above-mentioned two factors.

(9) Description of a Water-Resistant Fabric

With respect to an inverted core-sheath composite yarn in which a melting point of a core component is lower than that of a sheath component, a fabric obtained by using this composite yarn is subjected to heat treatment under increased pressure, such as calendering or the like to provide an excellent water resistance, and it is preferably used in an umbrella fabric or a bag fabric. Such a water-resistant fabric is described below.

In such an invention, the fabric is rendered water-impermeable through heat-setting at a high pressure. Thus, a monofilament is not suited as a yarn. As a bag fabric, a multifilament having a total denier of 100 or more, preferably from 200 to 500 is required. When the total denier is less than 100, properties as a bag fabric are unsatisfactory.

In general, a denier of a single yarn is preferably between approximately 4 and 15, and the strength of the single yarn has to be 2 g/d or more.

As an umbrella fabric, a multifilament having a total denier of 300 or less, preferably between 30 and 150 is required. When the total denier exceeds 300, an umbrella fabric lacks fineness. Meanwhile, when it is less than 30, an umbrella fabric lacks a strength, and is excessively soft, making it hard to handle the same.

In general, a denier of a single yarn is preferably between 1 and 8, and a strength of a single yarn has to be 2 g/d or more.

The above-mentioned multifilament in which the structural single yarn is formed of the inverted core-sheath composite yarn is used in a part or the whole of a warp and/or a weft. When it is used only as a warp or a weft, its ratio is the lowest. Even in such a case, it is used at a ratio of at least 20%. When it is less than 20%, a product is poor in a water resistance and a shape stability, making it impossible to achieve the object of the present invention. The warp or the weft is naturally arranged uniformly, and intermingling is substantially preferable.

The multifilament to be intermingled with the inverted core-sheath composite yarn includes a multifilament of a polyamide filament or a polyester filament which is ordinarily used in a fabric, and a finished yarn thereof.

A water-resistant fabric is formed by using such yarn in a warp and/or a weft. In order to obtain a satisfactory water resistance, it is required to increase a density in weaving. When a sum of textile cover factors [(denier$^{0.5}$×count (yarns/inch)] in warp and weft directions is referred to as TCF, it is important to provide a high density in the range of 3,500>TCF>800, preferably 3,500>TCF>1,200. When TCF is less than 800, interstices in a texture cannot satisfactorily be filled by heat-setting under increased pressure through calendering or the like. Further, when TCF is more than 3,500, it is problematic in weaving. With respect to the texture of the fabric used, a plain weave fabric, its modified fabric, a twill fabric, its modified weave, a satin fabric and its modified fabric are preferable.

Water repellent finishing and waterproofing are substantially unnecessary in the fabric of the present invention, and this point is an important characteristic feature. However, these treatments can be conducted in a usual manner as required. For example, an acrylic, silicon-type or fluorine-type water repellent can be applied by spraying, batching, dipping, coating or the like.

It is advisable that the above-mentioned substantially amorphous polymer which has a softening point being at least 20° C. lower than that of the sheath component as measured by the above-mentioned thermomechanical analysis of JIS K 7196 and which does not have a melting point peak as measured by differential thermal analysis of conducting heating at a rate of temperature rise of 10° C./min in a nitrogen atmosphere is used as a core component of an inverted core-sheath composite yarn used in such a water-resistant fabric.

EXAMPLE 17

Example is specifically described below. A hydraulic pressure resistance in Example was measured according to a JIS L-1092A method (hydrostatic method). Further, with respect to a shape stability, a sample was wound on a glass tube 10 mm in diameter, heat-set at 160° C. for 3 minutes, and cooled. A load of 100 g/cm$^2$ was put on the sample which was open, and was removed after 5 minutes. At this time, the wound condition was visually estimated.

The following two raw yarns were prepared for a bag.

A core-sheath composite fiber wherein substantially amorphous copolyethylene terephthalate containing isophthalic acid (IPA) occupying 25 mol % of an acid component and having a softening point of approximately 150° C. with substantially no melting point as measured by differential thermal analysis (DSC) of conducting heating at a rate of temperature rise of 10° C./min in a nitrogen atmosphere was used as a core and polyamide was used as a sheath, was spun at a core/sheath ratio (volume ratio) of 1:1 to form a yarn of 210 d/16 f. This was designated a raw yarn a17.

Meanwhile, a yarn of 210 d/16 f formed of a regular polyamide obtained by a usual procedure was designated a raw yarn b17.

Plain weave fabrics were produced using the raw yarns a17 and b17 as a warp and a weft such that densities of the warp and the weft as finished were 64 yarns/inch and 46 yarns/inch, respectively. These fabrics were subjected to the same dyeing (jet dyeing machine) and finishing including heat-setting at increased pressure under the same conditions as in producing a polyester plain weave fabric and a polyamide plain weave fabric.

With respect to the thus-obtained fabrics for a bag, the fabric obtained by using the raw yarn a17 was not subjected to water repellent finishing, while the fabric obtained by using the raw yarn b17 was subjected to the ordinary water repellent finishing using a fluorine-type water repellent.

The water resistance and the shape stability of the two fabrics were measured. The results are shown in Table 12.

TABLE 12

| | Test for water resistance | | Test for shape stability | |
|---|---|---|---|---|
| Type of a fabric | Calendering temperature | Hydraulic pressure resistance (cm) | Heat treatment temperature and time | Stability |
| Fabric using raw yarn a14 (Invention) | 180° C. | 35 | 160° C. 3 min | yes |
| Fabric using raw yarn b14 (conventional product) | 180° C. | 20 | 160° C. 3 min | no |

The following two types of raw yarns were prepared for an umbrella fabric.

A yarn of 75 d/24 f composed of the same components as the core-sheath composite yarn used in the raw yarn a17 of Example 17 was designated a raw yarn c17. Meanwhile, a yarn of 75 d/24 f composed of a regular polyester obtained by a usual procedure was designated a raw yarn d14.

A plain weave fabric was formed using the raw yarns c17 and d17 in the warp and the weft such that the densities of the warp and the weft as finished were 100 yarns/inch and 90 yarns/inch, respectively. This fabric was designated a fabric A17. On the other hand, a plain weave fabric was formed using the raw yarn d17 in both the warp and the weft such that the densities of the warp and the weft as finished were 100 yarns/inch and 90 yarns/inch, respectively. This fabric was designated a fabric B17.

The thus-obtained umbrella fabrics were successively subjected to refining at 95° C., setting at 185° C. for 20 seconds, dyeing using a beam dyeing machine, coating with an acrylic resin at 120° C. and water repellent finishing with a fluorine-type resin at 170° C., to obtain two types of complete umbrella fabrics. The water resistance and the shape stability of the two fabrics were measured, and the results are shown in Table 13.

TABLE 13

| Type of a fabric | Test for water resistance | Test for shape stability |
|---|---|---|
| Fabric A17 (Invention) | Hydraulic pressure resistance (cm) 45 | Shape stability yes |
| Fabric B17 (Comparative Example) | Hydraulic pressure resistance (cm) 35 | Shape stability no |

In the present invention, a textile cover factor TCF is a sum of [denier$^{0.5}$×count (yarns/inch)] of a warp and a weft.

Industrial Applicability

As stated above, the composite yarn of the present invention has an excellent shape stability. Accordingly, it can be used in various products. It can be used quite efficiently in a pleated curtain or clothing, an artificial flower, a fan, a lamp shade, a raincoat, a window breaker, an umbrella, a tent, an automobile cover, a bag, globes, a carp streamer, a lantern and the like. A product having a shape retention can be obtained by heat-setting in a fixed shape. Especially when the composite yarn is used in a covering yarn of a urethane elastic yarn, a material of an artificial flower, artificial hairs of a wig, an embossed fabric and the like, quite outstanding effects can be provided.

Further, an excellent water resistance can be obtained by heat-setting the fabric obtained by using this composite yarn under increased pressure.

In the present invention, the fabric means any of a woven fabric, a knitted fabric and a non-woven fabric. The above-mentioned core-sheath composite yarn may be used in at least a part of the yarn constituting these fabrics. However, when a water-resistant product is obtained through heat-setting, this yarn has to be arranged uniformly on the overall fabric.

What is claimed is:

1. A core-sheath composite yarn having a core component and a sheath component, wherein a softening point of the core component as measured by thermomechanical analysis of JIS K 7196 is at least 20° C. lower than a softening point of the sheath component, and wherein the core component is formed of a substantially amorphous polymer that does not have a melting point peak as measured by differential thermal analysis of conducting heating in a nitrogen atmosphere at a rate of temperature rise of 10° C./min.

2. A covering yarn comprising the composite yarn recited in claim 1 as a sheath yarn, and a urethane elastic yarn as a core yarn.

3. A fabric formed at least partially from the composite yarn recited in claim 1, the fabric having shape stability by being heat-set in a fixed shape at a temperature higher than the softening point of the core component and lower than the softening point of the sheath component.

4. A pleated fabric obtained by applying creases or folds to a fabric formed of a filament yarn of a thermoplastic synthetic fiber, wherein the composite yam recited in claim 1 is used in the whole or a part of a warp group and/or a weft group of the fabric, and a specific filament yarn is used in at least 25% of a yarn group intersected with a pleat line.

5. An artificial flower comprising a fabric which contains the composite yarn recited in claim 1 in an amount of at least 10% by volume.

6. A wig comprising a base net, a plurality of artificial hairs implanted in the base net to be protruded outside and a coating body mounted integrally with an inside of the base net, wherein the composite yarn recited in claim 1 is used in at least the artificial hairs.

7. A fabric comprising a woven or knitted fabric composed of the composite yarn recited in claim 1 and a urethane elastic yarn, wherein the woven or knitted fabric is heat-treated under increased pressure after weaving or knitting to impart surface smoothness.

8. An embossed fabric having shape stability obtained by pressing an engraved heat roll on a fabric formed of a multifilament containing the composite yam recited in claim 1 in the whole or a part of a warp and/or a weft, wherein a sum of textile cover factors in warp and weft directions is within the range of from 800 to 2,500.

9. A method of forming a fabric having shape stability comprising:

forming a fabric from the composite yarn recited in claim 1; and heat-setting the fabric in a fixed shape at a temperature higher than the softening point of the core component and lower than the softening point of the sheath component.

10. A method of forming a pleated fabric comprising:

forming a fabric from a filament yarn of a thermoplastic synthetic fiber wherein the composite yarn recited in claim 1 is used in the whole or a part of a warp group and/or a weft group of the fabric, and a specific filament yarn is used in at least 25% of a yarn group intersected with a pleat line; and applying creases or folds to the fabric.

11. A method of forming a fabric comprising:

forming a woven or knitted fabric from the composite yarn recited in claim 1 and a urethane elastic yarn by weaving or knitting; and heat-treating the woven or knitted fabric under increased pressure after weaving or knitting to impart surface smoothness.

12. A method of forming an embossed fabric having shape stability comprising:

forming a fabric in which a multifilament formed of the composite yarn recited in claim 1 is used in the whole or a part of a warp and/or a weft, and a sum of textile cover factors in warp and weft directions is within the range of from 800 to 2,500; and pressing an engraved heat roll on the fabric.

13. An embossed fabric having shape stability obtained by pressing an engraved heat roll on a fabric formed of a multifilament of a thermoplastic synthetic fiber containing a structural single filament formed of a core-sheath composite yam in which a softening point of a sheath component as measured by thermomechanical analysis of JIS K 7196 is at least 20° C. lower than a softening point of a core component in the whole or a part of a warp and/or a weft, and a multifilament formed of a substantially amorphous polymer that does not have a melting point peak as measured by differential thermal analysis of conducting heating in a nitrogen atmosphere at a rate of temperature rise of 10° C./min as the sheath component, wherein a sum of textile cover factors in warp and weft directions is within the range of from 800 to 2,500.

14. A water-resistant fabric comprising a core-sheath composite yarn, wherein a melting point of a core component is lower than a melting point of a sheath component and a softening point of the core component as measured by thermomechanical analysis of JIS K 7196 is at least 20° C. lower than a softening point of the sheath component, and wherein the core component is formed of a substantially amorphous polymer that does not have a melting point peak as measured by differential thermal analysis of conducting heating in a nitrogen atmosphere at a rate of temperature rise of 10° C./min, the fabric being formed in a flat state by heat-setting under increased pressure at a temperature lower than the melting point of the sheath component.

* * * * *